US011024234B2

(12) United States Patent
Yuan et al.

(10) Patent No.: US 11,024,234 B2
(45) Date of Patent: Jun. 1, 2021

(54) SIGNAL COMBINATION CIRCUIT, GATE DRIVING UNIT, GATE DRIVING CIRCUIT AND DISPLAY DEVICE

(71) Applicants: HEFEI XINSHENG OPTOELECTRONICS TECHNOLOGY CO., LTD., Hefei (CN); BOE TECHNOLOGY GROUP CO., LTD., Beijing (CN)

(72) Inventors: Zhidong Yuan, Beijing (CN); Yongqian Li, Beijing (CN); Can Yuan, Beijing (CN); Min He, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 16 days.

(21) Appl. No.: 16/622,711

(22) PCT Filed: May 31, 2019

(86) PCT No.: PCT/CN2019/089631
§ 371 (c)(1),
(2) Date: Dec. 13, 2019

(87) PCT Pub. No.: WO2019/228522
PCT Pub. Date: Dec. 5, 2019

(65) Prior Publication Data

US 2020/0105202 A1 Apr. 2, 2020

(30) Foreign Application Priority Data

May 31, 2018 (CN) ..... 201810550161.6

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2300/0408* (2013.01);
(Continued)

(58) Field of Classification Search
CPC .. G09G 3/3266; G09G 3/3258; G09G 3/3677; G09G 3/3674; G09G 2320/029;
(Continued)

(56) References Cited

U.S. PATENT DOCUMENTS 7,439,947 B2 10/2008 Ko et al.
8,044,916 B2 10/2011 Kim
9,159,449 B2 10/2015 Jang
9,489,896 B2 11/2016 Wang
(Continued)

FOREIGN PATENT DOCUMENTS

CN 103000121 A 3/2013
CN 103915058 A 7/2014
CN 104252843 A 12/2014
(Continued)

OTHER PUBLICATIONS

First Office Action dated Aug. 28, 2019 for application No. CN201810550161.6 with English translation attached.

*Primary Examiner* — Jimmy H Nguyen
(74) *Attorney, Agent, or Firm* — Nath, Goldberg & Meyer; Joshua B. Goldberg

(57) ABSTRACT

Embodiments of the present disclosure provide a signal combination circuit, a gate driving unit, a gate driving circuit, and a display device, the signal combination circuit includes a first active level output circuit configured to write an active-level voltage to a driving signal output terminal in a case where a signal provided by a first signal output terminal or a second signal output terminal is at an active level, and a first inactive level output circuit configured to
(Continued)

write an inactive-level voltage to the driving signal output terminal in a case where the signals provided by the first signal output terminal and the second signal output terminal are at an inactive level. The signal combination circuit of the embodiments of the disclosure can realize the combination of the single pulse signals output by two shift registers, thereby outputting a double-pulse driving signal.

20 Claims, 8 Drawing Sheets

(52) U.S. Cl.
CPC ..... *G09G 2310/0243* (2013.01); *G09G 2310/0286* (2013.01); *G09G 2310/08* (2013.01)

(58) Field of Classification Search
CPC ..... G09G 2320/045; G09G 2310/08; G09G 2310/0243; G09G 2310/0286; G09G 2300/0819; G09G 2300/0408
USPC ..... 345/76, 213, 98–100
See application file for complete search history.

(56) References Cited

U.S. PATENT DOCUMENTS

| | | | | |
|---|---|---|---|---|
| 9,536,469 | B2 | 1/2017 | Li et al. | |
| 9,799,271 | B2 | 10/2017 | Wang et al. | |
| 9,898,959 | B2 | 2/2018 | Li | |
| 9,953,611 | B2 | 4/2018 | Wang | |
| 10,403,222 | B2 | 9/2019 | Zhao | |
| 2006/0244699 | A1* | 11/2006 | Yamazaki | G09G 3/3233 345/82 |
| 2014/0145924 | A1* | 5/2014 | Liu | G09G 3/3674 345/100 |
| 2016/0372046 | A1* | 12/2016 | Wang | G09G 3/3266 |
| 2017/0039930 | A1* | 2/2017 | Li | G11C 19/28 |
| 2017/0229069 | A1 | 8/2017 | Tanikame et al. | |
| 2017/0270892 | A1* | 9/2017 | Wang | G11C 19/28 |
| 2020/0105202 | A1 | 4/2020 | Yuan et al. | |

FOREIGN PATENT DOCUMENTS

| | | | |
|---|---|---|---|
| CN | 104269134 | A | 1/2015 |
| CN | 104700766 | A | 6/2015 |
| CN | 105118414 | A | 12/2015 |
| CN | 106898319 | A | 6/2017 |
| CN | 108766357 | A | 11/2018 |
| TW | I262469 | B | 9/2006 |
| WO | 2015158101 | A1 | 10/2015 |

* cited by examiner

REPLACEMENT SHEET

SIGNAL COMBINATION CIRCUIT, GATE DRIVING UNIT, GATE DRIVING CIRCUIT AND DISPLAY DEVICE

CROSS REFERENCE TO RELATED APPLICATIONS

The present application is a U.S. National Stage Application under U.S.C. § 371 of International Patent Application No. PCT/CN2019/089631, filed on May 31, 2019, which claims priority to China Patent Application No. 201810550161.6, filed on May 31, 2018 the disclosure of both which are incorporated by reference herein in entirety.

TECHNICAL FIELD

The present disclosure relates to the field of display technologies, and in particular, to a signal combination circuit, a gate driving unit, a gate driving circuit, and a display device.

BACKGROUND

In a process of driving organic light-emitting diodes (OLEDs) in an OLED display panel, due to performance difference (including difference caused by processes, difference caused by aging, and the like) between respective driving transistors or OLEDs, display brightness of the OLEDs is not uniform, and therefore, performance of each driving transistor or OLED need to be compensated.

External compensation is a common way of compensation. The external compensation means that a current (i.e., an electrical signal) at the driving transistor or the OLED is read by a sensing circuit, and then a more complex algorithm is implemented by means of an external integrated circuit chip to compensate for non-uniformity of a threshold voltage and mobility of the driving transistor, aging of the OLED, and the like.

The time (i.e., a sensing stage) for reading the current at the driving transistor or the OLED by the sensing circuit is in a stable display stage of the display panel, so that the transistor in the sensing circuit need to be turned on not only in a driving stage of the display panel but also in the stable display stage of the display panel. At this time, a gate driving unit in a gate driving circuit need to output a double-pulse signal (one pulse corresponds to the driving stage and the other pulse corresponds to the stable display stage) within a duration of one frame of picture. In a case where the gate driving unit is implemented by using a gate driving chip, although the double-pulse signal can be output, the gate driving chip has a large size, which is not favorable for implementing a narrow bezel of the display panel. In a case where the gate driving unit applies a Gate Driver on Array (GOA), although the narrow bezel design of the display panel may be realized, each shift register of the gate driving circuit can only output one single pulse signal within the duration of one frame of picture, and thus it is not applicable to a scenario of the external compensation.

BRIEF SUMMARY OF THE PRESENT DISCLOSURE

An embodiment of the present disclosure provides a signal combination circuit, including a first active level output circuit, a first inactive level output circuit, and a node voltage control circuit. The signal combination circuit is configured to combine pulse signals outputted from a first shift register and a second shift register, and the signal combination circuit, the first shift register and the second shift register are comprised by a gate driving unit having a driving signal output terminal. The first active level output circuit is coupled to an active level input terminal, a first signal output terminal of the first shift register, a second signal output terminal of the second shift register and a driving signal output terminal of the gate driving unit, and configured to write, in response to signals provided by the first signal output terminal and the second signal output terminal, an active-level voltage provided by the active level input terminal to the driving signal output terminal when a signal provided by the first signal output terminal or the second signal output terminal is at an active level. The node control circuit is coupled to the first inactive level output circuit at a control node, and further coupled to a first reset signal input terminal of the first shift register, a first pull-up node of the first shift register, a second signal output terminal of the second shift register, a first clock signal input terminal, a first operation power supply terminal, and a second operation power supply terminal, and configured to write, in response to signals provided by the first reset signal input terminal, the first pull-up node, the second signal output terminal, and the first clock signal input terminal, a first operation voltage provided by the first operation power supply terminal to the control node when the signal provided by the first signal output terminal or the second signal output terminal is at the active level, and a second operation voltage provided by the second operation power supply terminal to the control node when signals provided by the first signal output terminal and the second signal output terminal are both at an inactive level. The first inactive level output circuit is coupled to the control node, the inactive level input terminal and the driving signal output terminal, and configured to write, in response to a voltage of the control node, an inactive-level voltage provided by the inactive level input terminal to the driving signal output terminal when the voltage of the control node is the second operation voltage.

In some embodiments, the first active level output circuit includes a first transistor and a second transistor. A control electrode of the first transistor is coupled to the first signal output terminal, a first electrode of the first transistor is coupled to the active level input terminal, and a second electrode of the first transistor is coupled to the driving signal output terminal. A control electrode of the second transistor is coupled to the second signal output terminal, a first electrode of the second transistor is coupled to the active level input terminal, and a second electrode of the second transistor is coupled to the driving signal output terminal.

In some embodiments, the first inactive level output circuit includes a third transistor. A control electrode of the third transistor is coupled to the control node, a first electrode of the third transistor is coupled to the driving signal output terminal, and a second electrode of the third transistor is coupled to the inactive level input terminal.

In some embodiments, the node voltage control circuit includes a fourth transistor, a fifth transistor, a sixth transistor, a seventh transistor, and an eighth transistor. A control electrode of the fourth transistor is coupled to the second operation power supply terminal, a first electrode of the fourth transistor is coupled to the control node, and a second electrode of the fourth transistor is coupled to the second operation power supply terminal. A control electrode of the fifth transistor is coupled to the first reset signal input terminal, a first electrode of the fifth transistor is coupled to the first operation power supply terminal, and a second electrode of the fifth transistor is coupled to a control electrode of the sixth transistor. The control electrode of the sixth transistor is coupled to a first electrode of the seventh transistor and a first electrode of the eighth transistor, a first electrode of the sixth transistor is coupled to the control node, and a second electrode of the sixth transistor is coupled to the first operation power supply terminal. A control electrode of the seventh transistor is coupled to the first clock signal input terminal, and a second electrode of the seventh transistor is coupled to a second pull-up node. A control electrode of the eighth transistor is coupled to the first pull-up node, and a second electrode of the eighth transistor is coupled to the second operation power supply terminal.

In some embodiments, the signal combination circuit further includes a second active level output circuit and a second inactive level output circuit. The second active level output circuit is coupled to the active level input terminal, the first signal output terminal, the second signal output terminal, and a reset signal output terminal of the gate driving unit, and configured to write, in response to the signals provided by the first signal output terminal and the second signal output terminal, the active-level voltage provided by the active level input terminal to the reset signal output terminal when the signal provided by the first signal output terminal or the second signal output terminal is at the active level. The second inactive level output circuit is coupled to the control node, the inactive level input terminal, and the reset signal output terminal, and configured to write, in response to the voltage of the control node, the inactive-level voltage provided by the inactive level input terminal to the reset signal output terminal when the voltage of the control node is the second operation voltage.

In some embodiments, the second active level output circuit includes a ninth transistor and a tenth transistor. A control electrode of the ninth transistor is coupled to the first signal output terminal, a first electrode of the ninth transistor is coupled to the active level input terminal, and a second electrode of the ninth transistor is coupled to the reset signal output terminal. A control electrode of the tenth transistor is coupled to the second signal output terminal, a first electrode of the tenth transistor is coupled to the active level input terminal, and a second electrode of the tenth transistor is coupled to the reset signal output terminal.

In some embodiments, the second inactive level output circuit includes an eleventh transistor and a twelfth transistor. A control electrode of the eleventh transistor is coupled to the control node, a first electrode of the eleventh transistor is coupled to the first signal output terminal, and a second electrode of the eleventh transistor is coupled to the inactive level input terminal. A control electrode of the twelfth transistor is coupled to the control node, a first electrode of the twelfth transistor is coupled to the first signal output terminal, and a second electrode of the twelfth transistor is coupled to the reset signal output terminal.

An embodiment of the present disclosure further provides a gate driving unit, including: a first shift register, a second shift register, and a signal combination circuit configured to combine pulse signals output from the first shift register and the second shift register, where the signal combination circuit includes the above signal combination circuit.

Embodiments of the present disclosure also provide a gate driving circuit, including: a plurality of gate driving units coupled in cascade, each of the gate driving units includes the above gate driving unit, except for the gate driving unit of the first stage, a first writing signal input terminal of the first shift register in each of the gate driving units of other stages is coupled to the first signal output terminal of the first shift register in the gate driving unit of a previous stage, a second writing signal input terminal of the second shift register in each of the gate driving units of other stages is coupled to the second signal output terminal of the second shift register in the gate driving unit of a previous stage, and the driving signal output terminal of the gate driving unit of each stage is coupled to a corresponding gate line.

In some embodiments, the signal combination circuit in each of the plurality of gate driving units includes a second active level output circuit and a second inactive level output circuit. The second active level output circuit is coupled to the active level input terminal, the first signal output terminal, the second signal output terminal, and a reset signal output terminal of the gate driving unit, and configured to write, in response to the control of the signals provided by the first signal output terminal and the second signal output terminal, the active-level voltage provided by the active level input terminal to the reset signal output terminal when the signal provided by the first signal output terminal or the second signal output terminal is at the active level. The second inactive level output circuit is coupled to the control node, the inactive level input terminal, and the reset signal output terminal, and configured to write, in response to the control of the voltage of the control node, the inactive-level voltage provided by the inactive level input terminal to the reset signal output terminal when the voltage of the control node is the second operation voltage, and except for the gate driving unit of the last stage, the first reset signal input terminal of the first shift register in each of the gate driving units of other stages is coupled to the reset signal output terminal of the gate driving unit of a next stage, and the second reset signal input terminal of the second shift register in each of the gate driving unit of other stages is coupled to the second signal output terminal of the second shift register in the gate driving unit of a next stage.

In some embodiments, the signal combination circuit in each of the plurality of gate driving units includes a second active level output circuit and a second inactive level output circuit, the second active level output circuit is coupled to the active level input terminal, the first signal output terminal, the second signal output terminal, and a reset signal output terminal of the gate driving unit, and configured to write, in response to the control of the signals provided by the first signal output terminal and the second signal output terminal, the active-level voltage provided by the active level input terminal to the reset signal output terminal when the signal provided by the first signal output terminal or the second signal output terminal is at the active level, and the second inactive level output circuit is coupled to the control node, the inactive level input terminal, and the reset signal output terminal, and configured to write, in response to the control of the voltage of the control node, the inactive-level voltage provided by the inactive level input terminal to the reset signal output terminal when the voltage of the control node is the second operation voltage, and except for the gate driving unit of the last stage, the first reset signal input terminal of the first shift register in each of the gate driving units of other stages is coupled to the first signal output terminal of the first shift register in the gate driving unit of a next stage, and the second reset signal input terminal of the second shift register in each of the gate driving unit of other stages is coupled to the second signal output terminal of the second shift register in the gate driving unit of a next stage.

In some embodiments, the first active level output circuit further includes a first capacitor and a second capacitor, a first terminal of the first capacitor is coupled to the control electrode of the first transistor, and a second terminal of the first capacitor is coupled to the driving signal output terminal, a first terminal of the second capacitor is coupled to the control electrode of the second transistor, and a second terminal of the second capacitor is coupled to the driving signal output terminal.

An embodiment of the present disclosure also provides a display device including the gate driving circuit as described above.

In some embodiments, the first shift register and the second shift register are configured to each output a single pulse signal, the signal combination circuit is configured to combine the single pulse signals output from the first shift register and the second shift register to output a double-pulse driving signal. A timing when each of the first shift register and the second shift register outputs the single pulse signal and pulse widths of the single pulse signals are adjustable. The signal combination circuit is further configured to output the double-pulse driving signal to a corresponding gate line to drive a driving transistor in a pixel unit.

DRAWINGS

Figure 3A:
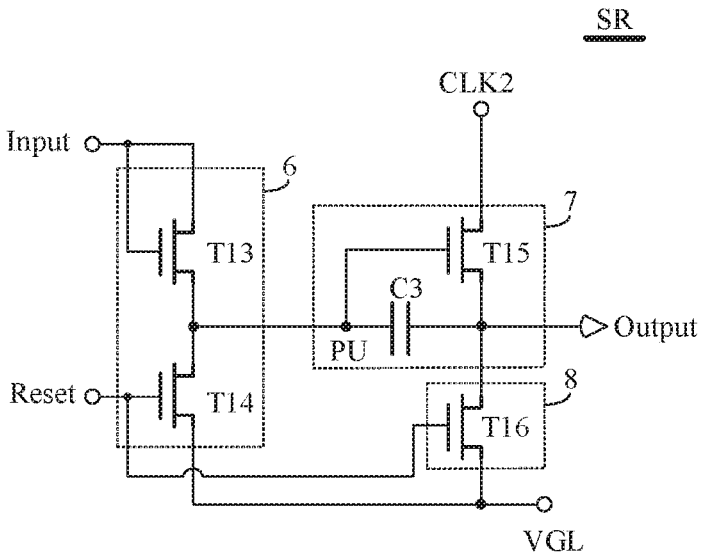
Figure 3B:
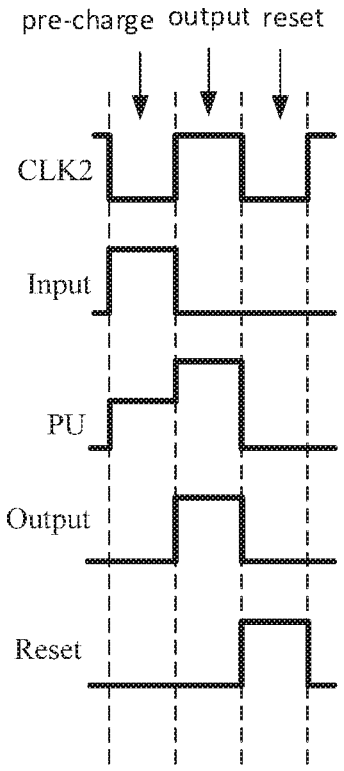

FIG. 3*a* is a schematic circuit structure diagram of a first shift register according to an embodiment of the present disclosure;

FIG. 3*b* is an operation timing diagram of the first shift register shown in FIG. 3*a;*

Figure 4A:
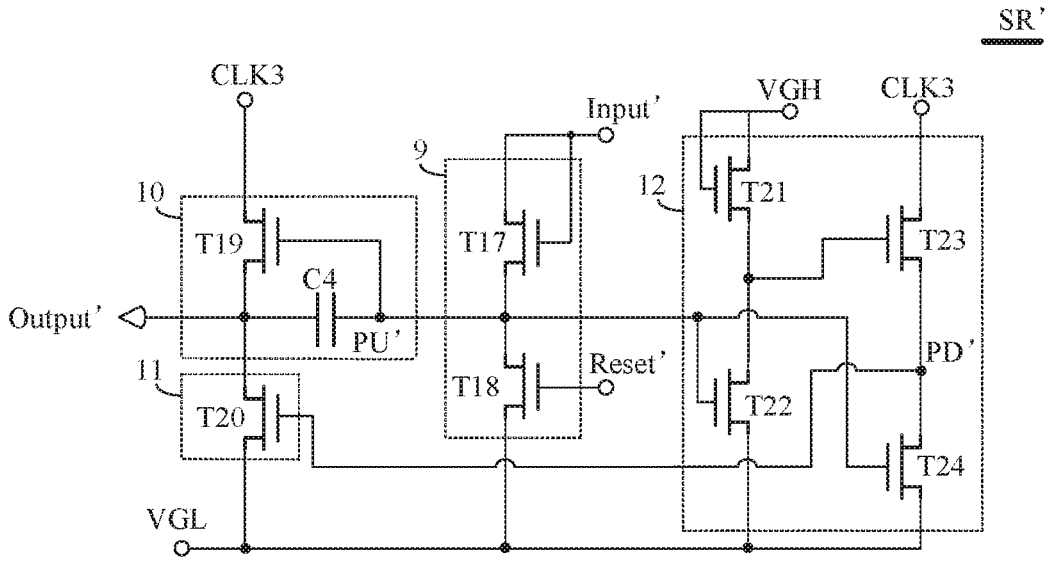
Figure 4B:
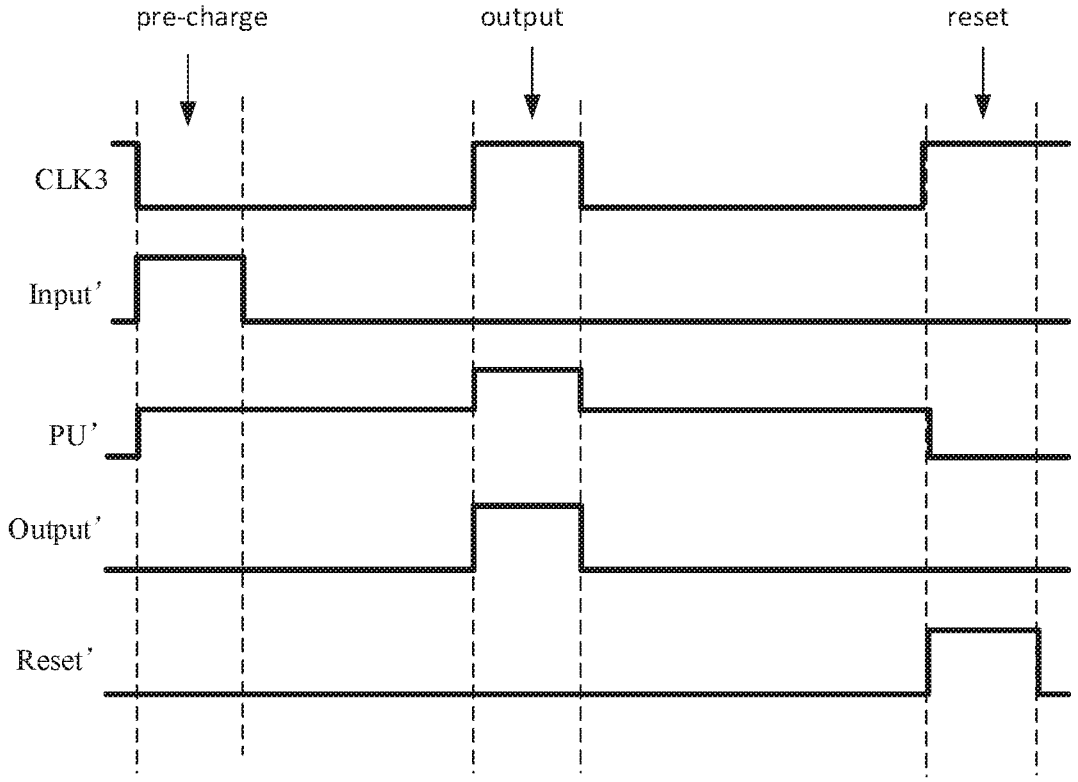

FIG. 4*a* is a schematic circuit structure diagram of a second shift register according to an embodiment of the present disclosure;

FIG. 4*b* is an operation timing diagram of the second shift register shown in FIG. 4*a;*

Figure 5:
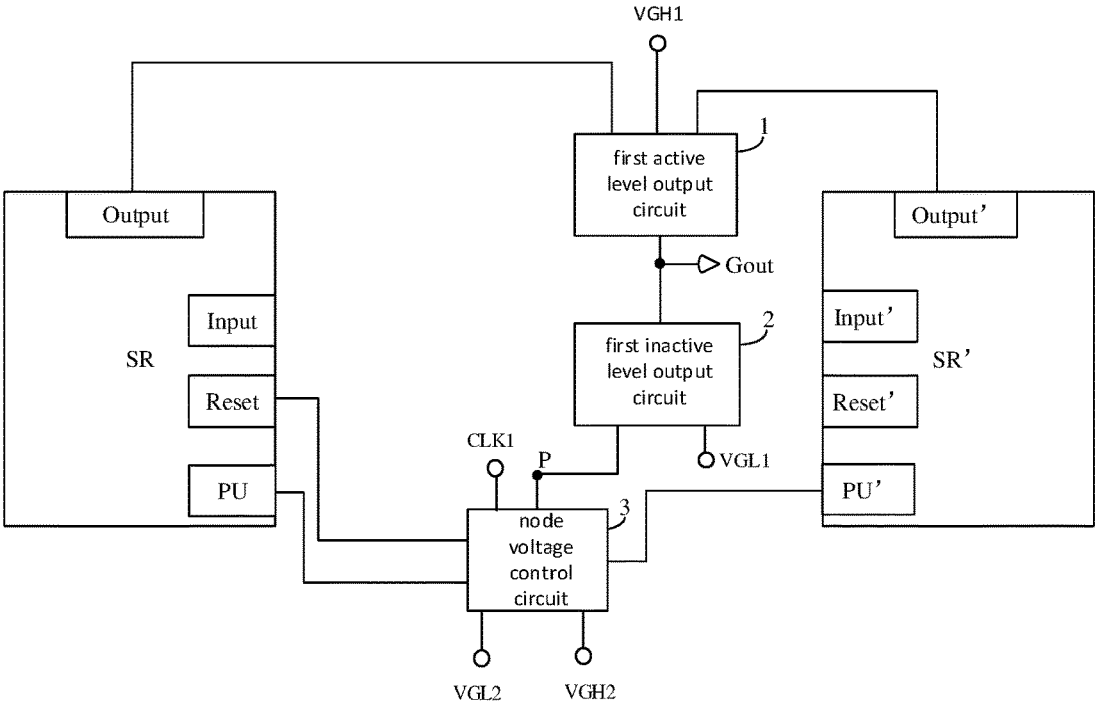
Figure 6:
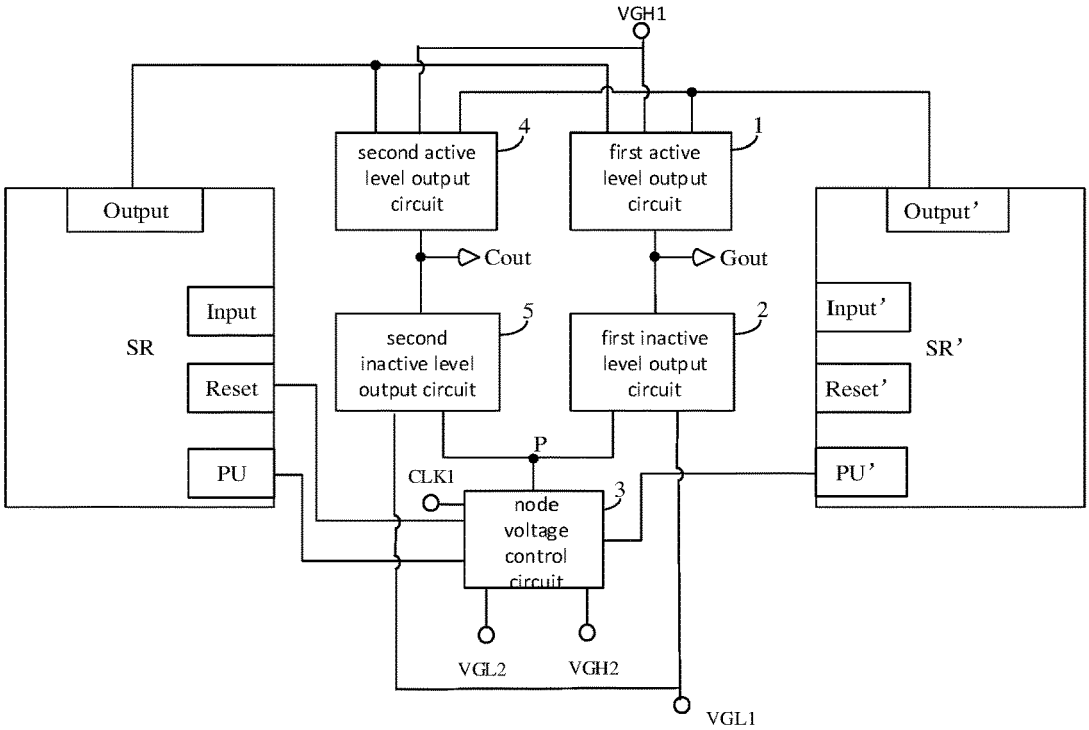
Figure 7:
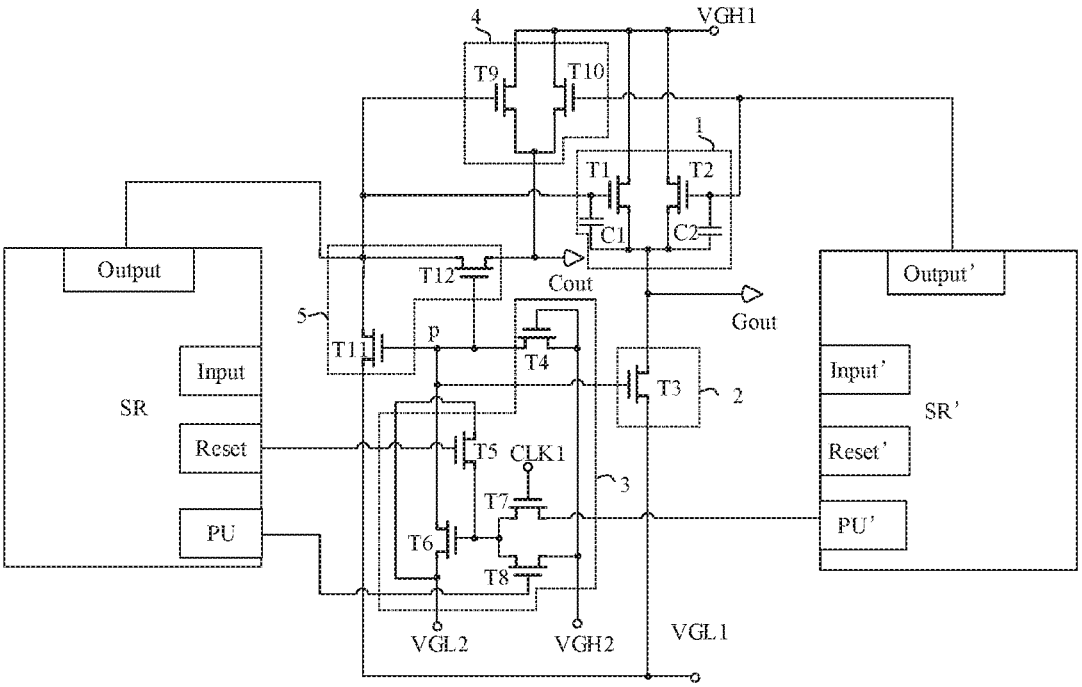
Figure 8:
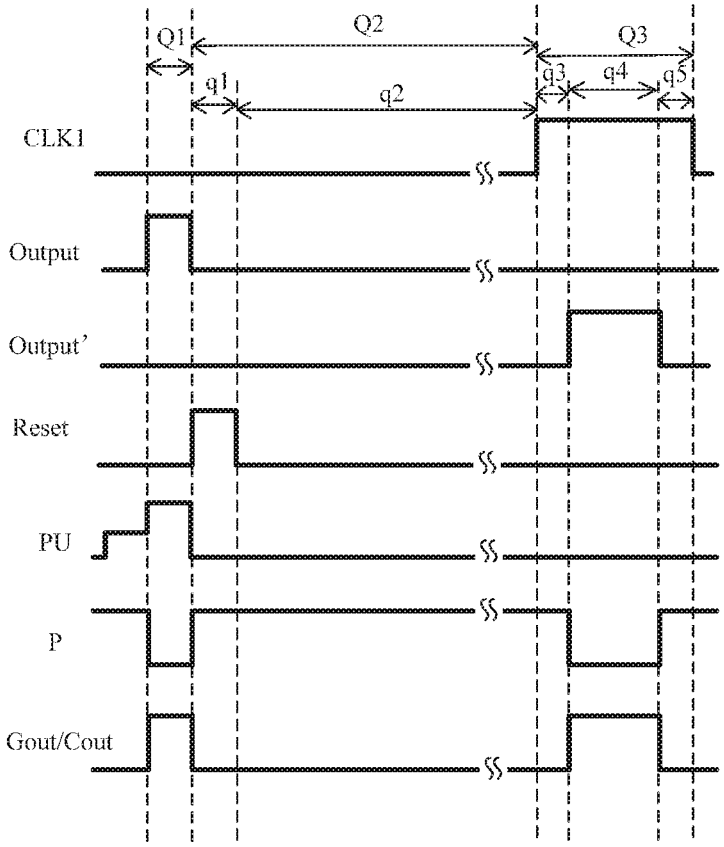
Figure 9:
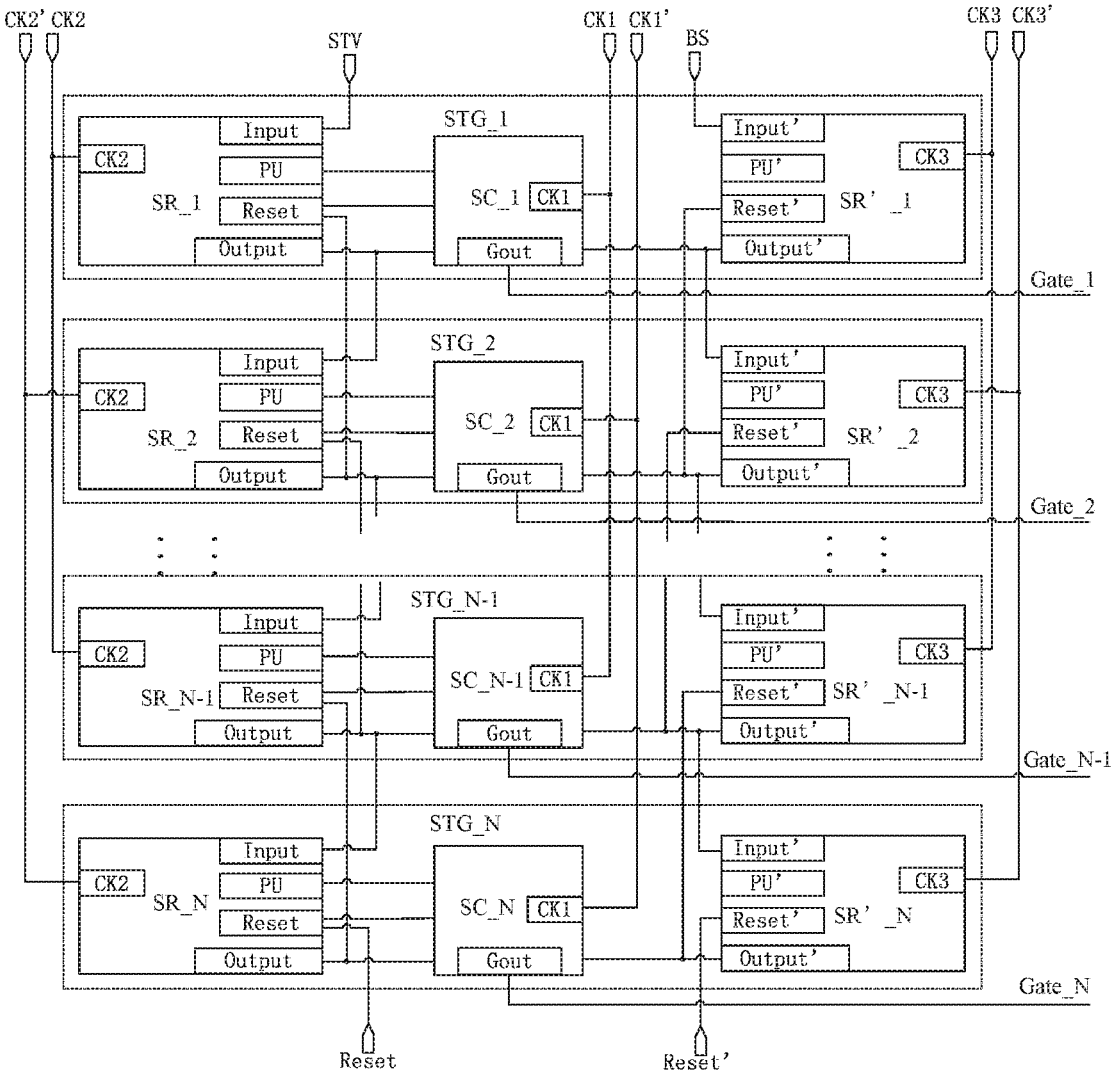
Figure 10:
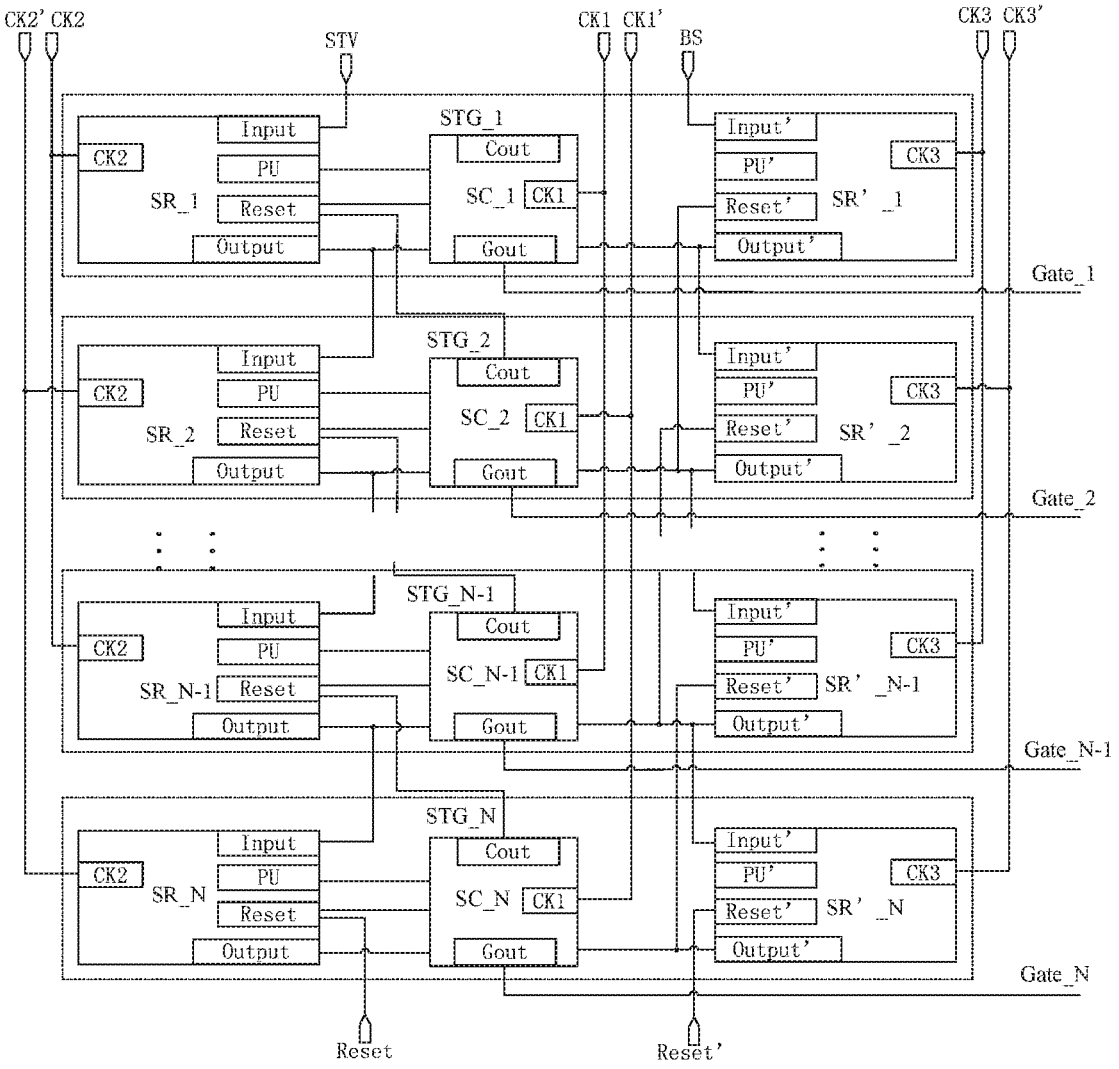
Figure 11:
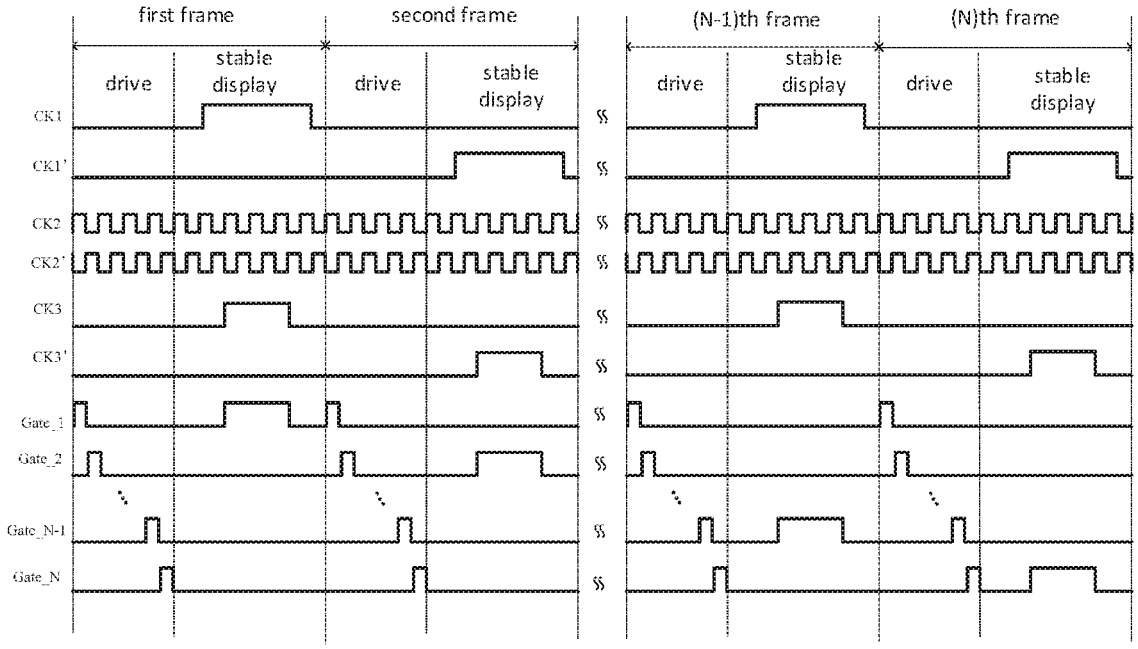

FIG. 5 is a schematic circuit structure diagram of a signal combination circuit according to an embodiment of the present disclosure;

FIG. 6 is another schematic circuit structure diagram of a signal combination circuit according to an embodiment of the present disclosure;

FIG. 7 is another schematic circuit structure diagram of a signal combination circuit according to an embodiment of the present disclosure;

FIG. 8 is an operation timing diagram of the signal combination circuit shown in FIG. 7;

FIG. 9 is a schematic circuit structure diagram of a gate driving circuit according to an embodiment of the present disclosure;

FIG. 10 is another schematic circuit structure diagram of a gate driving circuit according to an embodiment of the present disclosure; and FIG. 11 is an operation timing diagram of the gate driving circuits shown in FIGS. 9 and 10.

DETAILED DESCRIPTION

In order to make those skilled in the art better understand the technical solutions of the present disclosure, a signal combination circuit, a gate driving unit, a gate driving circuit and a display device provided in the embodiments of the present disclosure are described in detail below with reference to the accompanying drawings.

Figure 1:
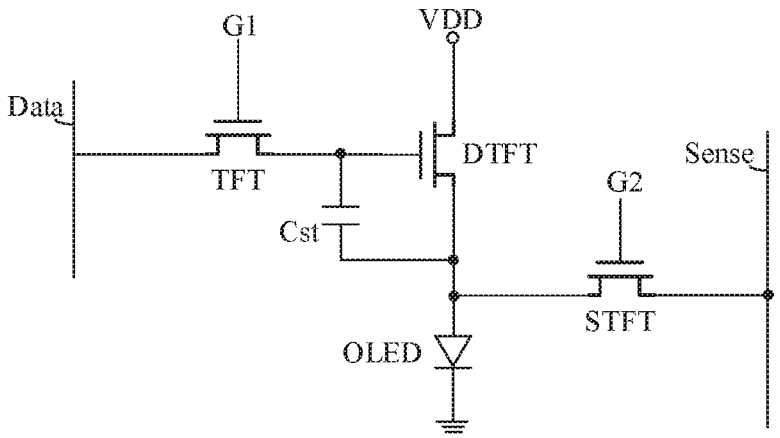
FIG. 1 is a schematic circuit structure diagram of a pixel circuit in an organic light emitting diode display panel.
Figure 2:
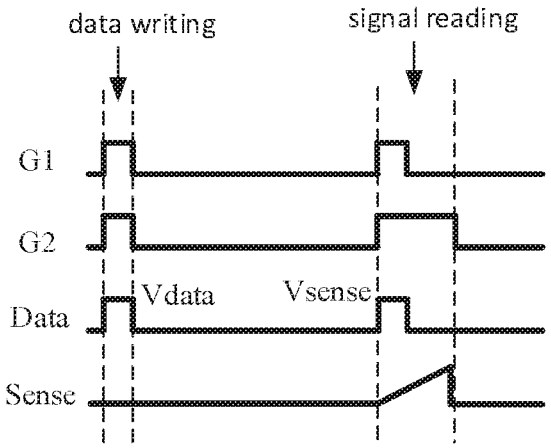
FIG. 2 is an operation timing diagram of the pixel circuit shown in FIG. 1.

FIG. 1 is a schematic circuit structure diagram of a pixel circuit in an organic light emitting diode display panel, and FIG. 2 is an operation timing diagram of the pixel circuit shown in FIG. 1. As shown in FIGS. 1 and 2, the pixel circuit includes a switching transistor TFT, a driving transistor DTFT, a sensing transistor STFT, and a capacitor Cst. In a case where an external compensation need to be carried out on the pixel circuit, an operation process of the pixel circuit at least includes the following two stages: a data writing stage and a sensing stage (including a signal reading process).

In the data writing stage, a data voltage Vdata in a data line Data need to be written into the pixel unit. In the sensing stage, a test voltage Vsense needs to be written into the pixel unit through the data line Data, and an electrical signal at a drain of the driving transistor is read to a signal reading line Sense through the sensing transistor STFT. In both the data writing stage and the sensing stage, an active-level voltage needs to be written to a gate of the sensing transistor STFT through a corresponding gate line G2.

Since a duration of the sensing stage is longer than that of the data writing stage, the gate line G2 coupled to the gate of the sensing transistor STFT needs to output a double-pulse signal within a duration of one frame, and a width of a pulse corresponding to the sensing stage is longer than a width of a pulse corresponding to the data writing stage. Therefore, the gate driving unit needs to have a function of outputting a double-pulse with two different pulse widths.

The technical solutions of the present disclosure may be based on a GOA circuit to realize the function that each stage of gate driving unit may output a double-pulse with two different pulse widths. In addition, in order to avoid the signal reading process (performed in a stable display stage of the display panel) from affecting the display effect of the display panel, the signal reading process may be performed only on one row of pixel units in the display panel within a duration of one frame. It should be noted that the process of performing external compensation on the pixel unit in the OLED display panel belongs to the conventional technology in the art, and therefore, the compensation process and principle thereof are not described herein again.

The GOA circuit generally includes a plurality of shift, which are cascaded registers, the shift register in each stage includes a pre-charge reset circuit, a pull-up circuit and a pull-down circuit, and the pre-charge reset circuit and the pull-up circuit are coupled to a pull-up node. An operation process of the shift register includes three stages: a pre-charge stage, an output stage, and a reset stage.

In the pre-charge stage, the pre-charge reset circuit pre-charges the pull-up node in response to a control of a writing signal provided by a writing signal input terminal, to prepare for the subsequent output stage.

In the output stage, the pull-up circuit outputs, in response to a control of a potential of the pull-up node, an active-level voltage to a signal output terminal, namely, a single pulse is output.

In the reset stage, the pre-charge reset circuit resets, in response to a control of a reset signal provided by a reset signal input terminal, the pull-up node, so that the pull-up circuit stops operating, meanwhile, the pull-down circuit outputs, in response to a control of a potential of a pull-down node or the control of the reset signal provided by the reset signal input terminal, an inactive-level voltage to the signal output terminal, so that the reset is performed.

According to the technical solution of the present disclosure, the single pulse signals output by two separated (not coupled with each other) shift registers are combined to output a double-pulse signal. Because the two shift registers are separated from each other, output timings and the pulse widths of the single pulse signals are adjustable, so that the sensing transistor STFT in the pixel unit can be driven by the double-pulse signal obtained by combining the two single pulse signals. In order to combine the single pulse signals output by the two shift registers, an embodiment of the present disclosure provides a signal combination circuit. The signal combination circuit and two corresponding shift registers form a gate driving unit, and the gate driving unit is provided with a driving signal output terminal for outputting a double-pulse driving signal to a corresponding gate line so as to drive each sensing transistor STFT coupled with the gate line.

For convenience of description, two shift registers of which the output single pulse signals are to be combined are referred to as a first shift register and a second shift register in the present disclosure, respectively, the writing signal input terminal, the reset signal input terminal, the signal output terminal, and the pull-up node of the first shift register are referred to as a first writing signal input terminal, a first reset signal input terminal, a first signal output terminal, and a first pull-up node, respectively, and the writing signal input terminal, the reset signal input terminal, the signal output terminal, and the pull-up node of the second shift register are referred to as a second writing signal input terminal, a second reset signal input terminal, a second signal output terminal, and a second pull-up node, respectively.

In addition, in the following embodiments, an example in which the active level is a high level and the inactive level is a low level is described, and at this time, the pulse signals output from the first shift register and the second shift register are positive pulse signals. It should be understood by those skilled in the art that in the present disclosure, the active level may be a low level, and the inactive level may be a high level, where the pulse signals output by the first shift register and the second shift register are negative pulse signals.

The transistors involved in the present disclosure may be independently selected from one of polysilicon thin film transistors, amorphous silicon thin film transistors, and oxide thin film transistors. An electron mobility of the polysilicon active layer is the largest and is one order of magnitude higher than that of the oxide active layer and two orders of magnitude higher than that of the amorphous silicon active layer, so that the advantages of the polysilicon thin film transistor and the oxide thin film transistor are obvious under the condition of large high resolution or large driving load. For achieving a same charging rate, sizes of the polysilicon thin film transistor and the oxide thin film transistor are relative small, and thus size of the shift register is relative small, the overall size of the gate driving circuit is relative small, facilitating the narrow bezel of the display panel. In addition, each transistor involved in the present disclosure may be the oxide thin film transistor in consideration of poor uniformity of film formation of the polysilicon active layer.

A "control electrode" involved in the present disclosure refers to a gate of a transistor, a "first electrode" refers to a source of the transistor, and a "second electrode" refers to a drain of the transistor. Of course, those skilled in the art will appreciate that the "first electrode" and "second electrode" are interchangeable.

FIG. 3*a* is a schematic circuit structure diagram of a first shift register according to an embodiment of the present disclosure, and FIG. 3*b* is an operation timing diagram of the first shift register shown in FIG. 3*a*. As shown in FIGS. 3*a* and 3*b*, as an example of the first shift register SR in the embodiment of the present disclosure, the first shift register SR may include: a first pre-charge reset circuit 6, a first pull-up circuit 7, and a first pull-down circuit 8.

The first pre-charge reset circuit 6 includes: a thirteenth transistor T13 and a fourteenth transistor T14. A control electrode of the thirteenth transistor T13 is coupled to a first writing signal input terminal Input, a first electrode of the thirteenth transistor T13 is coupled to the first writing signal input terminal Input, and a second electrode of the thirteenth transistor T13 is coupled to a first pull-up node PU. A control electrode of the fourteenth transistor T14 is coupled to a first reset signal input terminal Reset, a first electrode of the fourteenth transistor T14 is coupled to the first pull-up node PU, and a second electrode of the fourteenth transistor T14 is coupled to a low-level operation power supply terminal. The low-level operation power supply terminal provides a low-level operation voltage VGL.

The first pull-up circuit 7 includes: a fifteenth transistor T15 and a third capacitor C3. A control electrode of the fifteenth transistor T15 is coupled to the first pull-up node PU, a first electrode of the fifteenth transistor T15 is coupled to a second clock signal input terminal CLK2, and a second electrode of the fifteenth transistor T15 is coupled to a first signal output terminal Output. A first terminal of the third capacitor C3 is coupled to the first pull-up node PU, and a second terminal of the third capacitor C3 is coupled to the first signal output terminal Output. The second clock signal input terminal CLK2 provides a second clock signal CK2.

The first pull-down circuit 8 includes: a sixteenth transistor T16. A control electrode of the sixteenth transistor T16 is coupled to the first reset signal input terminal Reset, a first electrode of the sixteenth transistor T16 is coupled to the first signal output terminal Output, and a second electrode of the sixteenth transistor T16 is coupled to the low-level operation power supply terminal.

An operation process of the first shift register SR shown in FIG. 3*a* includes a pre-charge stage, an output stage and a reset stage.

In the pre-charge stage, the first writing signal input terminal provides a high level signal, the thirteenth transistor T13 is turned on to pre-charge the first pull-up node PU, the first pull-up node PU is at a high level, the fifteenth transistor T15 is turned on, the low-level voltage provided by the second clock signal input terminal CLK2 is written to the first signal output terminal Output through the fifteenth transistor T15, and the first signal output terminal Output outputs a low level.

In the output stage, the fifteenth transistor T15 is kept turned on, a high-level voltage provided by the second clock signal input terminal CLK2 is written to the first signal output terminal Output through the fifteenth transistor T15, and the first signal output terminal Output outputs a high level. In this process, the third capacitor C3 pulls up the voltage of the first pull-up node PU to a higher potential due to the bootstrap effect thereof.

In the reset stage, the first reset signal input terminal Reset provides a high level signal, and the fourteenth transistor T14 is turned on to reset the first pull-up node PU. At the same time, the sixteenth transistor T16 is turned on, the low-level operation voltage VGL is written to the first signal output terminal Output through the sixteenth transistor T16, and the first signal output terminal Output outputs a low level.

FIG. 4*a* is a schematic circuit structure diagram of a second shift register according to an embodiment of the present disclosure, and FIG. 4*b* is an operation timing diagram of the second shift register shown in FIG. 4*a*. As shown in FIGS. 4*a* and 4*b*, as an example of the second shift register SR' in an embodiment of the present disclosure, the second shift register SR' may include: a second pre-charge reset circuit 9, a second pull-up circuit 10, a second pull-down circuit 11, and a pull-down control circuit 12.

The second pre-charge reset circuit 9 includes: a seventeenth transistor T17 and an eighteenth transistor T18. A control electrode of the seventeenth transistor T17 is coupled to a second writing signal input terminal Input', a first electrode of the seventeenth transistor T17 is coupled to the second writing signal input terminal Input', and a second electrode of the seventeenth transistor T17 is coupled to a second pull-up node PU'. A control electrode of the eighteenth transistor T18 is coupled to a second reset signal input terminal Reset', a first electrode of the eighteenth transistor T18 is coupled to the second pull-up node PU', and a second electrode of the eighteenth transistor T18 is coupled to the low-level operation power supply terminal. The low-level operation power supply terminal provides the low-level operation voltage VGL.

The second pull-up circuit 10 includes: a nineteenth transistor T19 and a fourth capacitor C4. A control electrode of the nineteenth transistor T19 is coupled to the second pull-up node PU', a first electrode of the nineteenth transistor T19 is coupled to a third clock signal input terminal CLK3, and a second electrode of the nineteenth transistor T19 is coupled to a second signal output terminal Output'. A first terminal of the fourth capacitor C4 is coupled to the second pull-up node PU', and a second terminal of the fourth capacitor C4 is coupled to the second signal output terminal Output'. The third clock signal input terminal CLK3 provides a third clock signal CK3.

The first pull-down circuit 11 includes: a twentieth transistor T20. A control electrode of the twentieth transistor T20 is coupled to a pull-down node PD', a first electrode of the twentieth transistor T20 is coupled to the second signal output terminal Output', and a second electrode of the twentieth transistor T20 is coupled to the low-level operation power supply terminal.

The pull-down control circuit 12 includes: a twenty-first transistor T21, a twenty-second transistor T22, a twenty-third transistor T23, and a twenty-fourth transistor T24. A control of the twenty-first transistor T21 is coupled to a high-level operation power supply terminal, a first electrode of the twenty-first transistor T21 is coupled to the high-level operation power supply terminal, and a second electrode of the twenty-first transistor T21 is coupled to a control electrode of the twenty-third transistor T23. A control electrode of the twenty-second transistor T22 is coupled to the second pull-up node PU', a first electrode of the twenty-second transistor T22 is coupled to the control electrode of the twenty-third transistor T23, and a second electrode of the twenty-second transistor T22 is coupled to the low-level operation power supply terminal. A first electrode of the twenty-third transistor T23 is coupled to the third clock signal input terminal CLK3, and a second electrode of the twenty-third transistor T23 is coupled to the pull-down node PD'. A control electrode of the twenty-fourth transistor T24 is coupled to the second pull-up node PU', a first electrode of the twenty-fourth transistor T24 is coupled to the pull-down node PD', and a second electrode of the twenty-fourth transistor T24 is coupled to the low-level operation power supply terminal.

An operation of the second shift register SR' shown in FIG. 4*a* includes a pre-charge stage, an output stage and a reset stage.

In the pre-charge stage, the second writing signal input terminal Input' provides a high level signal, and the seventeenth transistor T17 is turned on to pre-charge the second pull-up node PU', and the second pull-up node PU' is at a high level. The nineteenth transistor T19 is turned on, and the low-level voltage provided by the third clock signal input terminal CLK3 is written to the second signal output terminal Output' through the nineteenth transistor T19, and the second signal output terminal Output' outputs a low level. In this process, since the second pull-up node PU' is at a high level, the twenty-second transistor T22 and the twenty-fourth transistor T24 are both turned on, the low-level operation voltage VGL is written to the control electrode of the twenty-third transistor T23 through the twenty-second transistor T22, the twenty-third transistor T23 is turned off, the low-level operation voltage VGL is written to the pull-down node PD' through the twenty-fourth transistor T24, the voltage of the pull-down node PD' is VGL, and the twentieth transistor T20 is turned off.

In the output stage, the nineteenth transistor T19 is kept turned on, and a high-level voltage provided by the third clock signal input terminal CLK3 is written to the second signal output terminal Output' through the nineteenth transistor T19, and the second signal output terminal Output' outputs a high level. In this process, the fourth capacitor C4 pulls up the voltage of the second pull-up node PU' to a higher potential due to the bootstrap effect thereof. In this process, the twenty-second transistor T22 and the twenty-fourth transistor T24 are kept turned on, the twenty-third transistor T23 is kept to be turned off, the voltage of the pull-down node PD' is kept to be VGL, and the twentieth transistor T20 is kept to be turned off.

It should be noted that the nineteenth transistor T19 is kept turned on for a period from the end of the output stage to the beginning of the reset stage, but at a time when the output stage ends, the signal provided by the third clock signal input terminal CLK3 becomes from a high level to a low level, so the second signal output terminal Output' changes to output a low level.

In the reset stage, the second reset signal input terminal Reset' provides a high level signal, the eighteenth transistor T18 is turned on, and the low-level operation voltage VGL is written to the second pull-up node PU' through the eighteenth transistor T18 to reset the second pull-up node PU'. At this time, the voltage of the second pull-up node PU' is VGL, the twenty-second transistor T22 and the twenty-fourth transistor T24 are all turned off, a high-level operation voltage VGH is written to the control electrode of the twenty-third transistor T23 through the twenty-first transistor T21, the twenty-third transistor T23 is turned on, the high-level voltage provided by the third clock signal input terminal CLK3 is written to the pull-down node PD' through the twenty-third transistor T23, the voltage of the pull-down node PD' is the high-level voltage, the twentieth transistor T20 is turned on, the low-level operation voltage VGL is written to the second signal output terminal Output' through the twentieth transistor T20, and the second signal output terminal Output' outputs a low level.

It should be appreciated by those skilled in the art that the first shift register SR and the second shift register SR' in the embodiment of the present disclosure are not limited to those shown in FIGS. 3*a* and 4*a* described above. The first shift register SR and the second shift register SR' in the embodiments of the present disclosure may also adopt other structures.

FIG. 5 is a schematic circuit structure diagram of a signal combination circuit according to an embodiment of the present disclosure, and as shown in FIG. 5, the signal combination circuit is configured to combine pulse signals output by the first shift register SR and the second shift register SR'.

As an example, the description will be made by taking a case where the single pulse signal output from the first shift register SR corresponds to the driving signal in the data writing stage and the single pulse signal output from the second shift register SR' corresponds to the driving signal in the sensing stage. Therefore, a pulse width of the single pulse signal output from the first shift register SR is smaller than a pulse width of the single pulse signal output from the second shift register SR'.

The signal combination circuit includes: a first active level output circuit 1, a first inactive level output circuit 2, and a node voltage control circuit 3.

The first active-level output circuit 1 is coupled to an active level input terminal (as shown in FIG. 7), the first signal output terminal Output of the first shift register SR, the second signal output terminal Output' of the second shift register SR', and a driving signal output terminal Gout of the gate driving unit, and is configured to write, in response to a control of signals provided by the first signal output terminal Output and the second signal output terminal Output', an active-level voltage provided by an active-level input terminal to a driving signal output terminal Gout when a signal provided by the first signal output terminal Output or the second signal output terminal Output' is at an active level.

The node voltage control circuit 3 is coupled to the first inactive level output circuit 2 at a control node P, and also coupled to the first reset signal input terminal Reset of the first shift register SR, the first pull-up node PU of the first shift register SR, the second pull-up node PU' of the second shift register SR', a first clock signal input terminal CLK1 (as shown in FIG. 7), a first operation power supply terminal (as shown in FIG. 7), and a second operation power supply terminal (as shown in FIG. 7), and is configured to write, in response to a control of the signals provided by the first reset signal input terminal Reset, the first pull-up node PU, the second pull-up node PU' and the first clock signal input terminal CLK1, a first operation voltage provided by the first operation power supply terminal to the control node P when the signal provided by the first signal output terminal Output or the second signal output terminal Output' is at the active level, and to write a second operation voltage provided by the second operation power supply terminal to the control node P when the signals provided by the first signal output terminal Output and the second signal output terminal Output' are all at an inactive level.

The first inactive level output circuit 2 is coupled to the control node P, an inactive level input terminal (as shown in FIG. 7), and the driving signal output terminal Gout, and is configured to write, in response to a control of a voltage of the control node P, an inactive-level voltage provided by the inactive level input terminal to the driving signal output terminal Gout when the voltage of the control node P is at the second operation voltage.

The operation process of the signal combination circuit may be classified into the following three cases (1) to (3) according to the difference between the states of the pulse signals provided by the first signal output terminal Output and the second signal output terminal Output'.

(1) The pulse signal provided by the first signal output terminal Output is at the active level, and the pulse signal provided by the second signal output terminal output' is at the inactive level. In this case, the first active level output circuit 1 writes the active-level voltage provided by the active level input terminal to the driving signal output terminal Gout, that is, the driving signal output terminal Gout outputs the active-level voltage, and a duration (i.e., the pulse width) thereof is the same as a duration (i.e., the pulse width) of the pulse signal provided by the first signal output terminal Output at the active level.

(2) The pulse signal provided by the first signal output terminal Output is at the inactive level, and the pulse signal provided by the second signal output terminal Output' is at the inactive level. In this case, the first inactive level output circuit 2 writes the inactive-level voltage provided by the inactive level input terminal to the driving signal output terminal Gout, that is, the driving signal output terminal Gout outputs the inactive-level voltage.

(3) The pulse signal provided by the first signal output terminal Output is at the inactive level, and the pulse signal provided by the second signal output terminal Output' is at the active level. In this case, the first active level output circuit 1 writes the active-level voltage provided by the active level input terminal to the driving signal output terminal Gout, that is, the driving signal output terminal Gout outputs the active-level voltage, and a duration (i.e., the pulse width) thereof is the same as a duration (i.e., the pulse width) of the pulse signal provided by the second signal output terminal Output' at the active level.

It should be noted that, in the signal combination process, a situation that the pulse signals provided by the first signal output terminal Output and the second signal output terminal Output' are both at the active level does not occur.

As can be seen from the above, the technical solution of the present disclosure can implement the combination of the single pulse signals output by the two shift registers, thereby outputting a double-pulse driving signal to meet the requirement for driving the sensing transistor. In addition, the technical solution is based on the GOA circuit, so that the narrow bezel design of the OLED display panel is facilitated.

FIG. 6 is another schematic circuit structure diagram of a signal combination circuit according to an embodiment of the present disclosure, and as shown in FIG. 6, the signal combination circuit includes not only the first active level output circuit 1, the first inactive level output circuit 2, and the node voltage control circuit 3, but also a second active level output circuit 4 and a second inactive level output circuit 5.

The second active level output circuit 4 is coupled to the active level input terminal (as shown in FIG. 7), the first signal output terminal Output, the second signal output terminal Output' and the reset signal output terminal Cout of the gate driving unit, and is configured to write, in response to the control of the signals provided by the first signal output terminal Output and the second signal output terminal Output', write the active-level voltage provided by the active-level input terminal to the reset signal output terminal Cout when the signal provided by the first signal output terminal Output or the second signal output terminal Output' is at the active-level.

The second inactive level output circuit 5 is coupled to the control node P, the inactive level input terminal (as shown in FIG. 7), and the reset signal output terminal Cout, and is configured to write, in response to the control of the voltage of the control node P, the inactive-level voltage provided by the inactive level input terminal to the reset signal output terminal Cout when the voltage of the control node P is the second operation voltage.

In the embodiment of the present disclosure, the signal output from the reset signal output terminal Cout is identical to the signal output from the driving signal output terminal Gout, and the reset signal output terminal Cout can provide a reset signal for the first shift register SR in the gate driving unit of a previous stage to reduce a burden of the signal output terminal of the first shift register SR in the gate driving unit of the present stage (in the related art, the signal output terminal needs to provide a writing signal for the first shift register SR in the gate driving unit of the next stage and also needs to provide a reset signal for the first shift register SR in the gate driving unit of the previous stage), thereby ensuring the reliability of the signal output from the first signal output terminal Output of the first shift register SR in the gate driving unit of the present stage.

FIG. 7 is another schematic circuit structure diagram of a signal combination circuit according to an embodiment of the present disclosure, and as shown in FIG. 7, the signal combination circuit is an example of the signal combination circuits shown in FIG. 5 and FIG. 6.

The first active level output circuit 1 may include a first transistor T1 and a second transistor T2. A control electrode of the first transistor T1 is coupled to the first signal output terminal Output, a first electrode of the first transistor T1 is coupled to the active level input terminal, and a second electrode of the first transistor T1 is coupled to the driving signal output terminal Gout. A control electrode of the second transistor T2 is coupled to the second signal output terminal Output', a first electrode of the second transistor T2 is coupled to the active level input terminal, and a second electrode of the second transistor T2 is coupled to the driving signal output terminal Gout.

The first inactive level output circuit 2 may include a third transistor T3. A control electrode of the third transistor T3 is coupled to the control node P, a first electrode of the third transistor T3 is coupled to the driving signal output terminal Gout, and a second electrode of the third transistor T3 is coupled to the inactive level input terminal.

The node voltage control circuit 3 may include a fourth transistor T4, a fifth transistor T5, a sixth transistor T6, a seventh transistor T7, and an eighth transistor T8. A control electrode of the fourth transistor T4 is coupled to the second operation power supply terminal, a first electrode of the fourth transistor T4 is coupled to the control node P, and a second electrode of the fourth transistor T4 is coupled to the second operation power supply terminal. A control electrode of the fifth transistor T5 is coupled to the first reset signal input terminal Reset, a first electrode of the fifth transistor T5 is coupled to the first operation power supply terminal, and a second electrode of the fifth transistor T5 is coupled to a control electrode of the sixth transistor T6. The control electrode of the sixth transistor T6 is coupled to a first electrode of the seventh transistor T7 and a first electrode of the eighth transistor T8, a first electrode of the sixth transistor T6 is coupled to the control node P, and a second electrode of the sixth transistor T6 is coupled to the first operation power supply terminal. A control electrode of the seventh transistor T7 is coupled to the first clock signal input terminal CLK1, and a second electrode of the seventh transistor T7 is coupled to the second pull-up node PU'. A control electrode of the eighth transistor T8 is coupled to the first pull-up node PU, and a second electrode of the eighth transistor T8 is coupled to the second operation power supply terminal.

In a case where the signal combination circuit includes the second active level output circuit 4 and the second inactive level output circuit 5, the second active level output circuit 4 may include a ninth transistor T9 and a tenth transistor T10, and the second inactive level output circuit 5 may include an eleventh transistor T11 and a twelfth transistor T12. A control electrode of the ninth transistor T9 is coupled to the first signal output terminal Output, a first electrode of the ninth transistor T9 is coupled to the active level input terminal, and a second electrode of the ninth transistor T9 is coupled to the reset signal output terminal Cout. A control electrode of the tenth transistor T10 is coupled to the second signal output terminal Output', a first electrode of the tenth transistor T10 is coupled to the active level input terminal, and a second electrode of the tenth transistor T10 is coupled to the reset signal output terminal Cout. A control electrode of the eleventh transistor T11 is coupled to the control node P, a first electrode of the eleventh transistor T11 is coupled to the first signal output terminal Output, and a second electrode of the eleventh transistor T11 is coupled to the inactive level input terminal. A control electrode of the twelfth transistor T12 is coupled to the control node P, a first electrode of the twelfth transistor T12 is coupled to the first signal output terminal Output, and a second electrode of the twelfth transistor T12 is coupled to the reset signal output terminal Cout.

The process of the signal combination circuit shown in FIG. 7 for combining the single pulse signals provided by the first signal output terminal Output and the second signal output terminal Output' will be described in detail below.

Corresponding to a condition that the active level is a high level, at this time, transistors in the signal combination circuit are all N-type transistor, the active level input terminal provides a high-level voltage VGH1, the inactive level input terminal provides a low-level voltage VGL1, the first operation voltage provided by the first operation power supply terminal is a low-level operation voltage VGL2, and the second operation voltage provided by the second operation power supply terminal is a high-level operation voltage VGH 2.

FIG. 8 is an operation timing diagram of the signal combination circuit shown in FIG. 7, and as shown in FIG. 8, the operation of the signal combination circuit may be divided into three time periods: a first time period Q1, a second time period Q2, and a third time period Q3.

In the first time period Q1 (corresponding to the data writing stage), the pulse signal provided by the first signal output terminal Output is at a high level, the pulse signal provided by the second signal output terminal Output' is at a low level (which corresponds to the above case (1)), the reset signal provided by the first reset signal input terminal Reset is at a low level, the voltage of the first pull-up node PU is at a high level, and the clock signal provided by the first clock signal input terminal CLK1 is at a low level.

Since the clock signal provided by the first clock signal input terminal CLK1 is at a low level, the seventh transistor T7 is turned off. Also, since the reset signal provided by the first reset signal input terminal Reset is at a low level, the fifth transistor T5 is turned off.

In addition, since the voltage of the first pull-up node PU is at a high level, the eighth transistor T8 is turned on, the high-level operation voltage VGH2 is written to the gate of the sixth transistor T6 through the eighth transistor T8, and thus the sixth transistor T6 is turned on, and the low-level operation voltage VGL2 is written to the control node P through the sixth transistor T6. At this time, the control node P is at a low level. Accordingly, the third transistor T3, the eleventh transistor T11, and the twelfth transistor T12 are all turned off, and the fourth transistor T4 may be equivalent to a resistor.

Meanwhile, since the pulse signal provided by the first signal output terminal Output is at a high level and the pulse signal provided by the second signal output terminal Output' is at a low level, the first transistor T1 and the ninth transistor T9 are both turned on, and the second transistor T2 and the tenth transistor T10 are both turned off. At this time, the high-level voltage VGH1 is written to the driving signal output terminal Gout through the first transistor T1, and written to the reset signal output terminal Cout through the ninth transistor T9. That is, the driving signal output terminal Gout and the reset signal output terminal Cout each output a high level (active level).

In the second time period Q2 (corresponding to the time period from a time when the data writing stage ends to a time when the sensing stage begins) includes: a first sub-stage q1 and a second sub-stage q2. The first sub-stage q1 corresponds to a stage where the first shift register SR is in the reset stage, and the second sub-stage q2 corresponds to a time period from a time when the reset stage of the first shift register SR ends to a time when the sensing stage begins.

In the first sub-stage q1, the pulse signal provided by the first signal output terminal Output is at a low level, the pulse signal provided by the second signal output terminal Output' is at a low level (which corresponds to the above case (2)), the reset signal provided by the first reset signal input terminal Reset is at a high level, the voltage of the first pull-up node PU is at a low level, and the clock signal provided by the first clock signal input terminal CLK1 is at a low level.

Since the pulse signal provided by the first signal output terminal Output is at a low level and the pulse signal provided by the second signal output terminal Output' is at a low level, the first transistor T1, the second transistor T2, the ninth transistor T9 and the tenth transistor T10 are all turned off.

Since the clock signal provided by the first clock signal input terminal CLK1 is at a low level, the seventh transistor T7 is turned off. Since the potential of the first pull-up node PU is at a low level, the eighth transistor T8 is turned off.

Meanwhile, since the reset signal provided by the first reset signal input terminal Reset is at a high level, the fifth transistor T5 is turned on, the low-level operation voltage VGL2 is written to the gate of the sixth transistor T6 through the fifth transistor T5, and the sixth transistor T6 is turned off. At this time, the high-level operation voltage VGH2 is written to the control node P through the fourth transistor T4, and the voltage of the control node P is VGH2. Accordingly, the third transistor T3, the eleventh transistor T11 and the twelfth transistor T12 are all turned on, the low-level voltage VGL1 is written to the driving signal output terminal Gout through the third transistor T3, and written to the reset signal output terminal Cout through the eleventh transistor T11 and the twelfth transistor T12. That is, the driving signal output terminal Gout and the reset signal output terminal Cout each output a low level (inactive level).

In the second sub-stage q2, the pulse signal provided by the first signal output terminal Output is at a low level, the pulse signal provided by the second signal output terminal Output' is at a low level (which corresponds to the above case (2)), the reset signal provided by the first reset signal input terminal Reset is at a low level, the voltage of the first pull-up node PU is at a low level, and the clock signal provided by the first clock signal input terminal CLK1 is at a low level.

Since the pulse signal provided by the first signal output terminal Output is at a low level, the pulse signal provided by the second signal output terminal Output' is at a low level, the clock signal provided by the first clock signal input terminal CLK1 is at a low level, and the potential of the first pull-up node PU is at a low level, the first transistor T1, the second transistor T2, the seventh transistor T7, the eighth transistor T8, the ninth transistor T9, and the tenth transistor T10 are all turned off.

Since the reset signal provided by the first reset signal input terminal Reset is at a low level, the fifth transistor T5 is turned off, and the gate of the sixth transistor T6 is in a floating state, thus the sixth transistor T6 maintains the turned-off state of the first sub-stage q1, and accordingly, the control node P also maintains the VGH2 of the first sub-stage q1. It should be noted that, when the voltage at the control node P is decreased due to the leakage current, the high-level operation voltage VGH2 charges the control node P through the fourth transistor T4 to maintain the voltage of the control node P at VGH2. Accordingly, in the second sub-stage q2, the third transistor T3, the eleventh transistor T11 and the twelfth transistor T12 are all turned on, the low-level voltage VGL1 is written to the driving signal output terminal Gout through the third transistor T3, and written to the reset signal output terminal Cout through the eleventh transistor T11 and the twelfth transistor T12. That is, the driving signal output terminal Gout and the reset signal output terminal Cout each output a low level (inactive level).

As can be seen from above, the driving signal output terminal Gout and the reset signal output terminal Cout both output a low level (inactive level) throughout the second time period Q2.

The third time period Q3 (corresponding to the sensing stage in which the clock signal provided by the first clock signal input terminal CLK1 is at a high level) includes: a third sub-stage q3, a fourth sub-stage q4 and a fifth sub-stage q 5.

In the third sub-stage q3, the pulse signal provided by the first signal output terminal Output is at a low level, the pulse signal provided by the second signal output terminal Output' is at a low level (which corresponds to the above case (2)), the reset signal provided by the first reset signal input terminal Reset is at a low level, the voltage of the first pull-up node PU is at a low level, and the clock signal provided by the first clock signal input terminal CLK1 is at a high level.

Since the pulse signal provided by the first signal output terminal Output is at a low level, the pulse signal provided by the second signal output terminal Output' is at a low level, the reset signal provided by the first reset signal input terminal Reset is at a low level, and the voltage of the first pull-up node PU is at a low level, the first transistor T1, the second transistor T2, the fifth transistor T5, the eighth transistor T8, the ninth transistor T9, and the tenth transistor T10 are all turned off.

Since the clock signal provided by the first clock signal input terminal CLK1 is at a high level, the seventh transistor T7 is turned on. Since the pulse signal provided by the second signal output terminal Output' is at a low level, correspondingly, the voltage of the second pull-up node PU' is a low-level voltage, the low-level voltage is written to the gate of the sixth transistor T6 through the seventh transistor T7, and the sixth transistor T6 is turned off. Accordingly, the high-level operation voltage VGH2 charges the control node P through the fourth transistor T4, the third transistor T3, the eleventh transistor T11, and the twelfth transistor T12 are all turned on, and the driving signal output terminal Gout and the reset signal output terminal Cout continuously output a low level (inactive level).

In the fourth sub-stage q4 (corresponding to a time period in which the sensing transistor reads signal, i.e., the sensing stage), the pulse signal provided by the first signal output terminal Output is at a low level, the pulse signal provided by the second signal output terminal Output' is at a high level (which corresponds to the above case (3)), the reset signal provided by the first reset signal input terminal Reset is at a low level, the voltage of the first pull-up node PU is at a low level, and the clock signal provided by the first clock signal input terminal CLK1 is at a high level.

Since the clock signal provided by the first clock signal input terminal CLK1 is at a high level, the seventh transistor T7 is turned on. Since the pulse signal provided by the second signal output terminal Output' is at a high level, correspondingly, the voltage of the second pull-up node PU' is a high-level voltage, the high-level voltage is written to the control electrode of the sixth transistor T6 through the seventh transistor T7, the sixth transistor T6 is turned on, the low-level operation voltage VGL2 is written to the control node P through the sixth transistor T6, and the voltage of the control node P is VGL2. Accordingly, the third transistor T3, the eleventh transistor T11, and the twelfth transistor T12 are all turned off.

In addition, since the voltage of the first pull-up node PU is at a low level, the eighth transistor T8 is turned off.

Meanwhile, since the pulse signal provided by the first signal output terminal Output is at a low level and the pulse signal provided by the second signal output terminal Output' is at a high level, the first transistor T1 and the ninth transistor T9 are both turned off, and the second transistor T2 and the tenth transistor T10 are both turned on. At this time, the high-level voltage VGH1 is written to the driving signal output terminal Gout through the second transistor T2, and written to the reset signal output terminal Cout through the tenth transistor T10. That is, the driving signal output terminal Gout and the reset signal output terminal Cout each output a high level (active level).

In the fifth sub-stage q5, the pulse signal provided by the first signal output terminal Output is at a low level, the pulse signal provided by the second signal output terminal Output' is at a low level (which corresponds to the above case (2)), the reset signal provided by the first reset signal input terminal Reset is at a low level, the voltage of the first pull-up node PU is at a low level, and the clock signal provided by the first clock signal input terminal CLK1 is at a high level.

Since the pulse signal provided by the first signal output terminal Output is at a low level and the pulse signal provided by the second signal output terminal Output' is at a low level, the first transistor T1, the second transistor T2, the ninth transistor T9 and the tenth transistor T10 are all turned off.

Also, since the reset signal provided by the first reset signal input terminal Reset is at a low level, the voltage of the first pull-up node PU is at a low level, the fifth transistor T5 and the eighth transistor T8 are both turned off.

Meanwhile, the clock signal provided by the first clock signal input terminal CLK1 is at a high level, and the seventh transistor T7 is turned on. Since the pulse signal provided by the second signal output terminal Output' is at a low level, correspondingly, the voltage of the second pull-up node PU' is a low-level voltage, the low-level voltage is written to the gate of the sixth transistor T6 through the seventh transistor T7, and the sixth transistor T6 is turned off. Accordingly, the high-level operation voltage VGH2 charges the control node P through the fourth transistor T4, the third transistor T3, the eleventh transistor T11, and the twelfth transistor T12 are all turned on, and the driving signal output terminal Gout and the reset signal output terminal Cout output a low level (inactive level).

It can be seen from above that the duration of the active level output by the driving signal output terminal Gout and the reset signal output terminal Cout in the third time period is the duration of the fourth sub-stage q4, i.e., the duration of the active level being output by the second signal output terminal Output'.

It should be noted that the third time period Q3 may only include the fourth sub-stage q4 and the fifth sub-stage q5. The time period in which the clock signal provided by the first clock signal input terminal CLK1 is at the active level covers the time period in which the second signal output terminal Output' outputs the active level, and the clock signal provided by the first clock signal input terminal CLK1 maintains the active level state for a period of time after the pulse signal output by the second signal output terminal Output' transits from the active level to the inactive level.

It should be understood by those skilled in the art that the signal combination circuit provided by the embodiment of the present disclosure may not include the second active level output circuit 4 (the ninth transistor T9 and the tenth transistor T10) and the second inactive level output circuit 5 (the eleventh transistor T11 and the twelfth transistor T12).

As can be seen from the foregoing, the signal combination circuit provided by the embodiments of the present disclosure can combine the signals output by the first shift register SR and the second shift register SR' to output a double-pulse signal.

The first active level output circuit 1 in the embodiment of the present disclosure may further include a first capacitor C1 and a second capacitor C2. A first terminal of the first capacitor C1 is coupled to the control electrode of the first transistor T1, and a second terminal of the first capacitor C1 is coupled to the driving signal output terminal Gout. A first terminal of the second capacitor C2 is coupled to the control electrode of the second transistor T2, and a second terminal of the second capacitor C2 is coupled to the driving signal output terminal Gout. In the embodiment of the present disclosure, the arrangement of the first capacitor C1 and the second capacitor C2 can effectively improve the output capability of the driving signal output terminal Gout.

Embodiments of the present disclosure also provide a gate driving unit, including: a first shift register SR, a second shift register SR', and the signal combination circuit of the embodiments of the present disclosure.

FIG. 9 is a schematic circuit structure diagram of a gate driving circuit according to an embodiment of the present disclosure. As shown in FIG. 9, the gate driving circuit includes N gate driving units STG_1, STG_2 . . . STG_N−1, STG_N coupled in cascade, wherein each of the gate driving units STG_1, STG_2 . . . STG_N−1, STG_N includes the gate driving unit of the embodiment of the present disclosure.

The first writing signal input terminal Input of the first shift register SR_1 in the gate driving unit STG_1 of the first stage is coupled to a frame trigger signal input terminal STV, and the second writing signal input terminal Input' of the second shift register SR'_1 in the gate driving unit STG_1 of the first stage is coupled to a sensing trigger signal input terminal BS.

Except for the gate driving unit STG_1 of the first stage, the first writing signal input terminal Input of each of the first shift registers SR_2 . . . SR_N−1 and SR_N in the gate driving units STG_2 . . . STG_N−1 and STG_N of other stages is coupled to the first signal output terminal Output of the first shift register in the gate driving unit of a previous stage, and the second writing signal input terminal Input' of each of the second shift registers SR'_2 . . . SR'_N−1 and SR'_N in the gate driving units STG_2 . . . STG_N−1 and STG_N of other stages is coupled to the second signal output terminal Output' of the second shift register in the gate driving unit of the previous stage.

Except for the gate driving unit STG_N of the last stage, the first reset signal input terminal Reset of each of the first shift registers SR_1 and SR_2 . . . SR_N−1 in the gate driving units STG_1 and STG_2 . . . STG_N−1 of other stages is coupled to the first signal output terminal Output of the first shift register in the gate driving unit of a next stage, and the second reset signal input terminal Reset' of each of the second shift registers SR'_2 . . . SR'_N−1 and SR'_N in the gate driving units STG_1 and STG_2 . . . STG_N−1 of other stages is coupled to the second signal output terminal Output' of the second shift register in the gate driving unit of the next stage.

The driving signal output terminal Gout of the signal combination circuits SC_1, SC_2 . . . SC_N−1, SC_N are coupled to corresponding Gate lines Gate_1, Gate_2 . . . Gate_N−1, Gate_N, respectively.

FIG. 10 is another schematic circuit structure diagram of a gate driving circuit according to an embodiment of the disclosure. The circuit structure shown in FIG. 10 is different from the circuit structure shown in FIG. 9 in that the signal combination circuit shown in FIG. 10 has not only the driving signal output terminal Gout but also the reset signal output terminal Cout (i.e., the signal combination circuit includes the second active level output circuit 4 and the second inactive level output circuit 5). At this time, except for the gate driving unit STG_N of the last stage, the first reset signal input terminal Reset of each of the first shift registers SR_1 and SR_2 . . . SR_N−1 in the gate driving units STG_1 and STG_2 . . . STG_N−1 of other stages is coupled to the reset signal output terminal Cout of the gate driving unit of the next stage.

Compared with the gate driving circuit shown in FIG. 9, in the gate driving circuit shown in FIG. 10, since the first signal output terminal Output of the first shift register in the gate driving unit of each stage does not need to provide a reset signal for the first shift register in the gate driving unit of the previous stage, the workload of the gate driving circuit can be reduced, and the reliability of the signal output by the first signal output terminal Output of the first shift register in the gate driving unit of each stage can be effectively improved.

FIG. 11 is an operation timing diagram of the gate driving circuits shown in FIGS. 9 and 10. As shown in FIG. 11, in a duration of any frame of an image, the first signal output terminals of the first shift registers (corresponding to the signals loaded on the Gate lines Gate_l, Gate_2 . . . Gate_N−1 and Gate_N in the driving stage) sequentially output pulse signals for displaying the image. In the duration of any frame of the image, only one of the second signal output terminals (corresponding to the signals loaded on the Gate lines Gate_l, Gate_2 . . . Gate_N−1 and Gate_N in the stable display stage) of the second shift registers outputs a pulse signal, so as to read signals from only one row of pixel units.

Embodiments of the present disclosure also provide a display device including the gate driving circuit of the embodiments of the present disclosure.

In various embodiments of the present disclosure, VGH, VGH1, and VGH2 may be the same, e.g., may all be a high level VDD, and VGL, VGL1, and VGL2 may be the same, e.g., may all be a low level Vss or a ground voltage level.

It is to be understood that the above embodiments are merely exemplary embodiments used for illustrating principles of the technical solutions of the present disclosure, and the present disclosure is not limited thereto. It will be apparent to those skilled in the art that various changes and modifications can be made therein without departing from the spirit of the present disclosure, and these changes and modifications should also be construed as falling within the scope of the present disclosure.

What is claimed is:

1. A signal combination circuit, comprising a first active level output circuit, a first inactive level output circuit, and a node voltage control circuit, wherein the signal combination circuit is configured to combine pulse signals outputted from a first shift register and a second shift register, the signal combination circuit, the first shift register and the second shift register are comprised by a gate driving unit having a driving signal output terminal, the first active level output circuit is coupled to an active level input terminal, a first signal output terminal of the first shift register, a second signal output terminal of the second shift register and the driving signal output terminal of the gate driving unit, and configured to write, in response to signals provided by the first signal output terminal and the second signal output terminal, an active-level voltage provided by the active level input terminal to the driving signal output terminal when a signal provided by the first signal output terminal or the second signal output terminal is at an active level, the node voltage control circuit is coupled to the first inactive level output circuit at a control node, and further coupled to a first reset signal input terminal of the first shift register, a first pull-up node of the first shift register, a second signal output terminal of the second shift register, a first clock signal input terminal, a first operation power supply terminal, and a second operation power supply terminal, and configured to write, in response to signals provided by the first reset signal input terminal, the first pull-up node, the second signal output terminal, and the first clock signal input terminal, a first operation voltage provided by the first operation power supply terminal to the control node when the signal provided by the first signal output terminal or the second signal output terminal is at the active level, and a second operation voltage provided by the second operation power supply terminal to the control node when signals provided by the first signal output terminal and the second signal output terminal are both at an inactive level, the first inactive level output circuit is coupled to the control node, an inactive level input terminal and the driving signal output terminal, and configured to write, in response to a voltage of the control node, an inactive-level voltage provided by the inactive level input terminal to the driving signal output terminal when the voltage of the control node is the second operation voltage.

2. The signal combination circuit of claim 1, wherein the first active level output circuit comprises a first transistor and a second transistor, a control electrode of the first transistor is coupled to the first signal output terminal, a first electrode of the first transistor is coupled to the active level input terminal, and a second electrode of the first transistor is coupled to the driving signal output terminal, and a control electrode of the second transistor is coupled to the second signal output terminal, a first electrode of the second transistor is coupled to the active level input terminal, and a second electrode of the second transistor is coupled to the driving signal output terminal.

3. The signal combination circuit of claim 2, wherein the first inactive level output circuit comprises a third transistor, a control electrode of the third transistor is coupled to the control node, a first electrode of the third transistor is coupled to the driving signal output terminal, and a second electrode of the third transistor is coupled to the inactive level input terminal.

4. The signal combination circuit of claim 3, wherein the node voltage control circuit comprises a fourth transistor, a fifth transistor, a sixth transistor, a seventh transistor, and an eighth transistor, a control electrode of the fourth transistor is coupled to the second operation power supply terminal, a first electrode of the fourth transistor is coupled to the control node, and a second electrode of the fourth transistor is coupled to the second operation power supply terminal, a control electrode of the fifth transistor is coupled to the first reset signal input terminal, a first electrode of the fifth transistor is coupled to the first operation power supply terminal, and a second electrode of the fifth transistor is coupled to a control electrode of the sixth transistor, the control electrode of the sixth transistor is coupled to a first electrode of the seventh transistor and a first electrode of the eighth transistor, a first electrode of the sixth transistor is coupled to the control node, and a second electrode of the sixth transistor is coupled to the first operation power supply terminal, a control electrode of the seventh transistor is coupled to the first clock signal input terminal, and a second electrode of the seventh transistor is coupled to a second pull-up node, and a control electrode of the eighth transistor is coupled to the first pull-up node, and a second electrode of the eighth transistor is coupled to the second operation power supply terminal.

5. The signal combination circuit of claim 4, further comprising a second active level output circuit and a second inactive level output circuit, the second active level output circuit is coupled to the active level input terminal, the first signal output terminal, the second signal output terminal, and a reset signal output terminal of the gate driving unit, and configured to write, in response to the control of the signals provided by the first signal output terminal and the second signal output terminal, the active-level voltage provided by the active level input terminal to the reset signal output terminal when the signal provided by the first signal output terminal or the second signal output terminal is at the active level, and the second inactive level output circuit is coupled to the control node, the inactive level input terminal, and the reset signal output terminal, and configured to write, in response to the control of the voltage of the control node, the inactive-level voltage provided by the inactive level input terminal to the reset signal output terminal when the voltage of the control node is the second operation voltage.

6. The signal combination circuit of claim 5, wherein the second active level output circuit comprises a ninth transistor and a tenth transistor, a control electrode of the ninth transistor is coupled to the first signal output terminal, a first electrode of the ninth transistor is coupled to the active level input terminal, and a second electrode of the ninth transistor is coupled to the reset signal output terminal, and a control electrode of the tenth transistor is coupled to the second signal output terminal, a first electrode of the tenth transistor is coupled to the active level input terminal, and a second electrode of the tenth transistor is coupled to the reset signal output terminal.

7. The signal combination circuit of claim 6, wherein the second inactive level output circuit comprises an eleventh transistor and a twelfth transistor, a control electrode of the eleventh transistor is coupled to the control node, a first electrode of the eleventh transistor is coupled to the first signal output terminal, and a second electrode of the eleventh transistor is coupled to the inactive level input terminal, and a control electrode of the twelfth transistor is coupled to the control node, a first electrode of the twelfth transistor is coupled to the first signal output terminal, and a second electrode of the twelfth transistor is coupled to the reset signal output terminal.

8. The signal combination circuit of claim 7, wherein the first active level output circuit further comprises a first capacitor and a second capacitor, a first terminal of the first capacitor is coupled to the control electrode of the first transistor, and a second terminal of the first capacitor is coupled to the driving signal output terminal, a first terminal of the second capacitor is coupled to the control electrode of the second transistor, and a second terminal of the second capacitor is coupled to the driving signal output terminal.

9. The signal combination circuit of claim 1, wherein the first inactive level output circuit comprises a third transistor, a control electrode of the third transistor is coupled to the control node, a first electrode of the third transistor is coupled to the driving signal output terminal, and a second electrode of the third transistor is coupled to the inactive level input terminal.

10. The signal combination circuit of claim 1, wherein the node voltage control circuit comprises a fourth transistor, a fifth transistor, a sixth transistor, a seventh transistor, and an eighth transistor, a control electrode of the fourth transistor is coupled to the second operation power supply terminal, a first electrode of the fourth transistor is coupled to the control node, and a second electrode of the fourth transistor is coupled to the second operation power supply terminal, a control electrode of the fifth transistor is coupled to the first reset signal input terminal, a first electrode of the fifth transistor is coupled to the first operation power supply terminal, and a second electrode of the fifth transistor is coupled to a control electrode of the sixth transistor, the control electrode of the sixth transistor is coupled to a first electrode of the seventh transistor and a first electrode of the eighth transistor, a first electrode of the sixth transistor is coupled to the control node, and a second electrode of the sixth transistor is coupled to the first operation power supply terminal, a control electrode of the seventh transistor is coupled to the first clock signal input terminal, and a second electrode of the seventh transistor is coupled to a second pull-up node, and a control electrode of the eighth transistor is coupled to the first pull-up node, and a second electrode of the eighth transistor is coupled to the second operation power supply terminal.

11. The signal combination circuit of claim 1, further comprising a second active level output circuit and a second inactive level output circuit, the second active level output circuit is coupled to the active level input terminal, the first signal output terminal, the second signal output terminal, and a reset signal output terminal of the gate driving unit, and configured to write, in response to the signals provided by the first signal output terminal and the second signal output terminal, the active-level voltage provided by the active level input terminal to the reset signal output terminal when the signal provided by the first signal output terminal or the second signal output terminal is at the active level, and the second inactive level output circuit is coupled to the control node, the inactive level input terminal, and the reset signal output terminal, and configured to write, in response to the voltage of the control node, the inactive-level voltage provided by the inactive level input terminal to the reset signal output terminal when the voltage of the control node is the second operation voltage.

12. The signal combination circuit of claim 11, wherein the second active level output circuit comprises a ninth transistor and a tenth transistor, a control electrode of the ninth transistor is coupled to the first signal output terminal, a first electrode of the ninth transistor is coupled to the active level input terminal, and a second electrode of the ninth transistor is coupled to the reset signal output terminal, and a control electrode of the tenth transistor is coupled to the second signal output terminal, a first electrode of the tenth transistor is coupled to the active level input terminal, and a second electrode of the tenth transistor is coupled to the reset signal output terminal.

13. The signal combination circuit of claim 11, wherein the second inactive level output circuit comprises an eleventh transistor and a twelfth transistor, a control electrode of the eleventh transistor is coupled to the control node, a first electrode of the eleventh transistor is coupled to the first signal output terminal, and a second electrode of the eleventh transistor is coupled to the inactive level input terminal, and a control electrode of the twelfth transistor is coupled to the control node, a first electrode of the twelfth transistor is coupled to the first signal output terminal, and a second electrode of the twelfth transistor is coupled to the reset signal output terminal.

14. A gate driving unit, comprising a first shift register, a second shift register, and a signal combination circuit configured to combine pulse signals output from the first shift register and the second shift register, wherein the signal combination circuit comprises the signal combination circuit of claim 1.

15. A gate driving circuit comprising a plurality of gate driving units coupled in cascade, wherein each of the gate driving units is the gate driving unit of claim 14, except for the gate driving unit of a first stage, a first writing signal input terminal of the first shift register in each of the gate driving units of other stages is coupled to the first signal output terminal of the first shift register in the gate driving unit of a previous stage, a second writing signal input terminal of the second shift register in each of the gate driving units of other stages is coupled to the second signal output terminal of the second shift register in the gate driving unit of a previous stage, and the driving signal output terminal of the gate driving unit of each stage is coupled to a corresponding gate line.

16. The gate driving circuit according to claim 15, wherein the signal combination circuit in each of the plurality of gate driving units comprises a second active level output circuit and a second inactive level output circuit, the second active level output circuit is coupled to the active level input terminal, the first signal output terminal, the second signal output terminal, and a reset signal output terminal of the gate driving unit, and configured to write, in response to the control of the signals provided by the first signal output terminal and the second signal output terminal, the active-level voltage provided by the active level input terminal to the reset signal output terminal when the signal provided by the first signal output terminal or the second signal output terminal is at the active level, and the second inactive level output circuit is coupled to the control node, the inactive level input terminal, and the reset signal output terminal, and configured to write, in response to the control of the voltage of the control node, the inactive-level voltage provided by the inactive level input terminal to the reset signal output terminal when the voltage of the control node is the second operation voltage, and except for the gate driving unit of the last stage, the first reset signal input terminal of the first shift register in each of the gate driving units of other stages is coupled to the reset signal output terminal of the gate driving unit of a next stage, and the second reset signal input terminal of the second shift register in each of the gate driving unit of other stages is coupled to the second signal output terminal of the second shift register in the gate driving unit of a next stage.

17. A display device comprising the gate driving circuit of claim 16.

18. The display device of claim 17, wherein the first shift register and the second shift register are configured to each output a single pulse signal, the signal combination circuit is configured to combine the single pulse signals output from the first shift register and the second shift register to output a double-pulse driving signal, and wherein a timing when each of the first shift register and the second shift register outputs the single pulse signal and pulse widths of the single pulse signals are adjustable, and the signal combination circuit is further configured to output the double-pulse driving signal to a corresponding gate line to drive a driving transistor in a pixel unit.

19. A display device comprising the gate driving circuit of claim 15.

20. The gate driving circuit according to claim 15, wherein the signal combination circuit in each of the plurality of gate driving units comprises a second active level output circuit and a second inactive level output circuit, the second active level output circuit is coupled to the active level input terminal, the first signal output terminal, the second signal output terminal, and a reset signal output terminal of the gate driving unit, and configured to write, in response to the control of the signals provided by the first signal output terminal and the second signal output terminal, the active-level voltage provided by the active level input terminal to the reset signal output terminal when the signal provided by the first signal output terminal or the second signal output terminal is at the active level, and the second inactive level output circuit is coupled to the control node, the inactive level input terminal, and the reset signal output terminal, and configured to write, in response to the control of the voltage of the control node, the inactive-level voltage provided by the inactive level input terminal to the reset signal output terminal when the voltage of the control node is the second operation voltage, and except for the gate driving unit of the last stage, the first reset signal input terminal of the first shift register in each of the gate driving units of other stages is coupled to the first signal output terminal of the first shift register in the gate driving unit of a next stage, and the second reset signal input terminal of the second shift register in each of the gate driving unit of other stages is coupled to the second signal output terminal of the second shift register in the gate driving unit of a next stage.

* * * * *